United States Patent [19]

Murayama et al.

[11] 4,202,687

[45] May 13, 1980

[54] LOW MELTING POINT NI-CR ALLOY FOR CAST DENTAL PRODUCTS

[75] Inventors: Kentaro Murayama, Osaka; Kazuyuki Nakano, Toyonaka, both of Japan

[73] Assignee: Sankin Industry Co., Ltd., Osaka, Japan

[21] Appl. No.: 24,864

[22] Filed: Mar. 28, 1979

[30] Foreign Application Priority Data

Apr. 5, 1978 [JP] Japan ..... 53-40698

[51] Int. Cl.[2] ..... C22C 19/05

[52] U.S. Cl. ..... 75/134 C; 75/171

[58] Field of Search ..... 75/171, 134 C

[56] References Cited

U.S. PATENT DOCUMENTS

| | | | |
|---|---|---|---|
| 3,437,480 | 4/1969 | Cape | 75/170 |
| 3,709,682 | 1/1973 | Belkovsky et al. | 75/134 C |
| 3,898,081 | 8/1975 | Kukhar | 75/171 |
| 3,907,555 | 9/1975 | Dudek et al. | 75/171 |
| 4,053,308 | 10/1977 | Tesk et al. | 75/171 |

*Primary Examiner*—L. Dewayne Rutledge
*Assistant Examiner*—Upendra Roy
*Attorney, Agent, or Firm*—Oblon, Fisher, Spivak, McClelland & Maier

[57] ABSTRACT

A low melting point Ni-Cr alloy is fusible easily with a low-calorie heat source commonly and easily available. The alloy comprises, Ni, Cr, Cu, Mn and Al as the principal components thereof and an appropriate deoxidizer. There is further added at least one alloy element selected from the group consisting of Ga, Nb and Zr or other alloy elements if circumstances permit. The low melting point of the alloy disclosed herein simplifies casting facilities, makes plaster molds usable and facilitates the removal of products after casting.

2 Claims, No Drawings

LOW MELTING POINT NI-CR ALLOY FOR CAST DENTAL PRODUCTS

BACKGROUND OF THE INVENTION

1. Field of the Invention

This invention relates to alloys for casting in the field of denistry, and more particularly to alloy compositions for the manufacture of various cast dental products such as crowns and bridges.

2. Description of the Prior art

Noble metals are generally known as alloys for casting dental crowns but are quite expensive. A Ni-Cr alloy is commonly used. Since the melting point of this alloy is higher than 1200° C., the alloy is difficulty fusible with a low-calorie heat source such as a gas oxygen mixture flame or gas air mixture flame from utility gas service. Such other measures as arc fusion or high frequency fusion are therefore widely employed for this purpose. In the latter case a centrifugal casting machine of high frequency dielectric heating type is required which is space consuming and rather expensive with attendant risks. In addition, the mold has to withstand high temperature conditions and requires normally the use of a filler or embedding material of the phosphate type which is highly resistant to temperature. However, the embedding material has too much strength and causes great inconvenience in destruction thereof at the removal of cast products.

Moreover, the filler is difficult to mix or knead and failure to knead it thoroughly results in nonuniformity of expansion coefficient during sintering. The filler further suffers from the drawback that it tends to be weathered during the course of three months or more after the manufacture thereof.

Dental crowns should not become discolored after installation nor should they injure the mating tooth or the occlusion counterpart, and further, of course, the crowns should be easily workable. A high degree of casting accuracy requires small casting shrinkage. The filler should not be attached or backed onto the surface of the casting products. There are therefore many requirements for alloys for dental casting applications.

SUMMARY OF THE INVENTION

With the foregoing in mind, it is therefore an object of the present invention to provide an alloy composition which is fusible and moldable easily by means of a low-calorie heat source and free of any inconvenience when installed within the oral cavity. More particularly, the present invention is to provide a low melting point alloy having an appropriate hardness and a high resistance to discoloration.

It is another object of the present invention to provide a low melting point alloy of which the shrinkage factor in casting is as small as possible and to which a filler does not bake-on.

It is still another object of the present invention to provide a low melting point alloy compatible with a filler which is low in heat resistance but easily destructible, for example, a plaster filler. Other objects of the present invention will be better understood by reference to the following disclosure.

The present invention accomplishes the above described objects by providing a Ni-Cr alloy which includes at least the following components:

| | |
|---|---|
| Cr | 7-20% |
| Cu | 15-35% |
| Mn | 15-35% |
| Ge | 0.5-15% |
| Al | 0.1-3% |
| Deoxidizer | 0.1-3% |
| | ni balance (by weight) |

If necessary, the alloy may include at least one alloy element selected from the group consisting of Ga, Nb and Zr or other alloy elements. It is recommended that the three elements be added to the alloy in the following compounding ratio.

| | | |
|---|---|---|
| Ga | 0.5-15% | |
| Nb | 0.5-10% | |
| Zr | 0.5-5% | |
| | | (by weight) |

Although Mn and Al of the above listed elements have the deoxidizing function, Si system, Ti system, Al system and Mn system alloys, for example, Ca-Si alloys are generally recommended as a deoxidizer.

DETAILED DESCRIPTION OF THE INVENTION

A representative example of cast products in the field of denistry is dental crowns. As is well known to those skilled in the art, the dental crowns require a variety of various functions and properties. As stated briefly above, the inventors made an intensive investigation for the best alloy composition which satisfies the requisites as follows:

(1) The melting point is as low as possible. As a proper criterion, the alloy compound is fully fusible with gas oxygen (or air) mixture flame from utility gas facilities (preferably below 1150° C.);

(2) It does not discolor with the oral cavity during a long term of use;

(3) Cast products are polishable and workable easily and have such hardness as not to damage the occlusion counterpart. It is desirable that Vickers hardness be smaller than 250;

(4) Casting shrinkage is small in order to enhance accuracy of casting. The Ni-Cr alloy is generally known as having a relatively high melting point and thus preferably includes as few elements of high melting point as possible; and (5) A filler is prevented from being baked onto the surface of cast products. Careful attention is needed in this connection since the Ni-Cr alloy has a relatively high melting point and such baking-on phenomena are much more likely to take place.

To fulfill the above discussed requisites, consideration was first given to Cr, and it was found that at least more than 7% of Cr should be added to comply with the requisite (2). In other words, less than 7% of Cr leads to the great possibility of discoloring. Should Cr be added at over 20%, the hardness will undergo a sharp increase such that problems are encountered in meeting the requisite (3) and the melting point becomes higher and casting shrinkage is increased. The total Cr content is therefore selected within the range of 7-20%, preferably in the range of 8-13% and more preferably in the range of 10-15%. The Cu content is delimited to the range of 15-35% as stated above. With less than 15% of Cu, it is difficult to lower the melting point and hence meet the requirement (3). When over 35% of Cu is added, the alloy compound does discolor during prolonged use. A desirable amount of Cu is 18–33%, the range of 20–30% being preferred.

While Mn is primarily intended to lower the melting point, less than 15% of Mn has no effect for this purpose and the lower limit thereof is set at 15%. The greater the Mn content the greater the effect of lowering the melting point. More than 35% of Mn results in increased hardness and fails to satisfy the requisite (3). Then, the upper limit is set at 35%. It is desirable than Mn be present within the range of 18–33%, more preferably in the range of 20–30%. Ge serves for a twofold purpose; one for lowering the melting point and the other for preventing discoloration. However, less than 0.5% of Ge is not remarkably effective for either of the stated ends and the lower limit thereof is placed at 0.5%. Though both functions are enhanced progressively with increasing Ge content, the hardness of the alloy will be too high to satisfy the requisite (3) when over 15% of Ge is added. The Ge content is therefore selected within the range of 0.5–15%, preferably in the range of 1–13% and more preferably in the range of 2–10%. Moreover, Al functions not only to lower the melting point but also prevent the filler from being baked on. Less than 0.1% of Al is deficient in those functions. The effects are amplified with an increase in the Al content. The alloy material becomes fragile with over 3% of Al. From the foregoing it is concluded that the Al content is selectable within the range of 0.1–3%, preferably 0.3–2% and more preferably 0.5–1%.

Although Mn, Al or the like manifests deoxidizing properties as stated above, a particular deoxidizer is to be added to improve the yield of those elements. An appropriate material for the deoxidizer is Si system Ti system, Al system and Mn system alloy such as Ca-Si alloys and Fe-Si alloys. The amount of the deoxidizer is specified in the range of 0.1–3%. Deoxidizer less than 0.1% brings about a shortage of deoxidization and deoxidizer in excess of 3% leads to an increase in hardness with the result of failure to meet the requisite (3) and fragility of the alloy material. A desirable compound ratio of the deoxidizer is within the range of 0.2–2%, preferably 0.3–1%.

The foregoing sets forth the respective essential and indispensable components of the alloy embodying the present invention in greater detail. The remaining components are generally Ni and unavoidable impurities. If necessary, the alloy may further include at least one alloy element selected from the group consisting of Ga, Nb, Zn and other alloying elements. Of those alloying elements Ga serves to lower the melting point and prevent discoloration. Less than 0.5 of Ga is not enough to serve these functions, the lower limit thereof being thus placed at 0.5%. These functions are improved with increasing Ga content but, when exceeding 15%, the hardness of the alloy becomes too high with respect to the requisite (3). A range of 0.5–15% of Ga is reasonable, preferably the range of 0.8–10% and more preferably 1–8%. While Nb and Zr are expected to show the same functions as Ga, a less than 0.5% amount is not satisfactory in this connection and this defines the lower limit thereof. On the other hand, these effects are similarly increased with increasing Nb or Zr content. The Nb content exceeding 10% suffers from the disadvantages of increasing the hardness of the alloy to the extent not to fulfill the requisite (3) and making the casting shrinkage of the alloy greater. A reasonable amount of Nb is within the range of 0.5–10%, preferably in the range of 0.8–8% and more desirably 1–5%. Zr is powerful enough to reduce the melting point and easy to grind. Less than 0.5% of Zr is not efficient enough, whereas Zr in excess of 5% makes the alloy hard and brittle and increases the casting shrinkage. A reasonable amount of Zr is selected from the range of 0.5–5%, preferably in the range of 1–4% and more desirably 2–3%.

The respective alloy components set forth above may be added solely, in combination or in an alloying mixture with iron. It is intended to encompass such alloy compositions within the scope of the present invention.

As the result of the foregoing alloy composition, the Ni-Cr alloy is relatively low in melting point and fusible and moldable with a low-calorie heat source such as gas oxygen (or air) mixture flame from utility gas service. A low-temperature plaster filler is therefore made available and destructible easily in removing cast products from a mold. In addition, the resultant alloy compound is of such hardness as to facilitate grinding and polishing. The manufacture of crowns, bridges, etc. is simplified with satisfactory discoloration-proof results, casting shrinkage and inhibition of baking attachment. Although the following sets forth a specific embodiment of the present invention, this embodiment is only illustrative of the present invention and it is not intended to limit the invention thereto.

EXAMPLE

Seven different alloy compositions as indicated in Table 1 were prepared and crowns and bridges were made by the established procedure of manufacturing crowns and bridges. The melting point, Vickers hardness, tensile strength and elongation of each product are given in Table 2, which shows that the alloys A to E were satisfactory in hardness and tensile strength but the alloys F and G had too great an elongation. In addition, while the alloys A to E were excellent in moldability, cast skin, grindability and adaptability to patients, the alloys F and G outside the scope of the present invention gave unsatisfactory results. Moreover, the alloys F and G tended to discolor within the oral cavity of a patient.

Table 1

| Composition | (Examples) | | | | | | |
|---|---|---|---|---|---|---|---|
| Alloy | A | B | C | D | E | F | G |
| Ni (%) | 26.5 | 27.6 | 35.5 | 31.2 | 32.1 | 64 | 49 |
| Cr (%) | 15 | 10 | 10 | 10 | 10 | 10 | 10 |
| Cu (%) | 30 | 25 | 20 | 25 | 25 | 10 | 30 |
| Mn (%) | 20 | 30 | 20 | 25 | 25 | 15 | 10 |
| Ge (%) | 7 | 5 | 5 | 5 | 2 | — | — |
| Al (%) | 0.5 | 0.1 | 1 | 0.5 | 0.1 | — | — |
| Ca - Si (%) | 1 | 0.3 | 1 | 0.3 | 0.3 | 1 | 1 |
| Ga (%) | — | 2 | — | — | 1 | — | — |
| Nb (%) | — | — | 5 | — | 1 | — | — |
| Zr (%) | — | — | — | 3 | 3 | — | — |
| Other (%) | — | — | 2.5 | — | 0.5 | — | — |

Table 2

| | (Test Results) | | | | | | |
|---|---|---|---|---|---|---|---|
| Alloy | A | B | C | D | E | F | G |
| Melting point (°C.) | 985 | 1000 | 1030 | 960 | 1030 | 1260 | 1240 |
| Vickers hardness | 247 | 232 | 235 | 226 | 240 | 140 | 168 |

Table 2-continued

| Alloy | A | B | C | D | E | F | G |
|---|---|---|---|---|---|---|---|
| | (Test Results) | | | | | | |
| Tensile strength ($kg/mm^2$) | 48.2 | 44.5 | 46.7 | 41.2 | 43.6 | 41.5 | 45.8 |
| Elongation (%) | 2.0 | 2.5 | 2.5 | 2.0 | 2.5 | 12.5 | 7.5 |

We claim:

1. A low melting point Ni-Cr alloy for dental casting comprising at least the following components:

| | |
|---|---|
| Cr | 7-20% |
| Cu | 15-35% |
| Mn | 15-35% |

-continued

| | |
|---|---|
| Ge | 0.5-15% |
| Al | 0.1-3% |
| Deoxidizer | 0.1-3% |
| | ni balance (by weight) |

2. The alloy according to claim 1 further comprising at least one alloy element selected from the group consisting of Ga, Nb and Zr in the following compounding ratio:

| | |
|---|---|
| Ga | 0.5-15% |
| Nb | 0.5-10% |
| Zr | 0.5-5% |
| | (by weight) |

* * * * *